US009526301B1

(12) United States Patent
Sloan

(10) Patent No.: US 9,526,301 B1
(45) Date of Patent: Dec. 27, 2016

(54) ADAPTABLE BUCKLE SYSTEM

(71) Applicant: Jill Sloan, Kernville, CA (US)

(72) Inventor: Jill Sloan, Kernville, CA (US)

( * ) Notice: Subject to any disclaimer, the term of this patent is extended or adjusted under 35 U.S.C. 154(b) by 0 days.

(21) Appl. No.: 14/936,041

(22) Filed: Nov. 9, 2015

Related U.S. Application Data

(60) Provisional application No. 62/173,635, filed on Jun. 10, 2015.

(51) Int. Cl.
*A44B 11/25* (2006.01)
*A44B 11/00* (2006.01)

(52) U.S. Cl.
CPC ..... *A44B 11/006* (2013.01); *A44B 11/25* (2013.01); *Y10T 24/1498* (2015.01); *Y10T 24/4086* (2015.01); *Y10T 24/4736* (2015.01)

(58) Field of Classification Search
CPC ..... Y10T 24/4764; Y10T 24/4736; Y10T 24/45277; Y10T 24/1498; Y10T 24/3413; Y10T 24/45283; Y10T 24/45529; A44B 11/06; A44B 11/006; A44B 11/2553; F16L 3/2332; E05B 75/00
See application file for complete search history.

(56) References Cited

U.S. PATENT DOCUMENTS 2,897,559 A * 8/1959 Erdmann ..... A44B 11/06 24/191
6,076,237 A * 6/2000 Goorhouse ..... A44B 11/263 24/200
6,101,687 A * 8/2000 Giampavolo ..... B60N 2/265 24/265 AL
7,100,251 B2 9/2006 Howell
7,448,116 B1 11/2008 Howell
2006/0123607 A1* 6/2006 Howell ..... A44B 11/263 24/615
2008/0028576 A1* 2/2008 Okamoto ..... B65D 63/1027 24/16 R
2011/0061211 A1 3/2011 Anscher
2011/0099776 A1* 5/2011 Anscher ..... A44B 11/266 24/629
2013/0224667 A1 8/2013 Roybal
2014/0298630 A1* 10/2014 Hortnagl ..... A44B 11/2592 24/697.2

* cited by examiner

*Primary Examiner* — Robert J Sandy
*Assistant Examiner* — Michael Lee
(74) *Attorney, Agent, or Firm* — Global Intellectual Property Agency, LLC; Daniel Boudwin

(57) ABSTRACT

An adaptable buckle system that can be secured to a loop in a strap or cable to replace a broken buckle or add a buckle. The present invention includes two component members, a male connector and a female connector, which removably engage to form a fastening buckle. Both components have an interlocking side-release mechanism at the end opposing the connector. The interlocking side-release mechanism comprises a receiver on one side of the component member configured to receive a prong extending from the free end of a flexible arm pivotally affixed to the other side of the component member. The flexible arm may be fed through a loop in a strap or cable. Ridges that line the inner surface of the prong and inner wall of the receiver cause a cross-biting action that secures the prong in place. The prong is released when the arm is twisted thereby rotating the prong.

7 Claims, 3 Drawing Sheets

ADAPTABLE BUCKLE SYSTEM

CROSS REFERENCE TO RELATED APPLICATIONS

This application claims the benefit of U.S. Provisional Application No. 62/173,635 filed on Jun. 10, 2015. The above identified patent application is herein incorporated by reference in its entirety to provide continuity of disclosure.

FIELD OF THE INVENTION

The present invention relates to buckles. More specifically, the present invention relates to systems for adaptable buckles that can be secured to a loop in any strap or cable.

BACKGROUND OF THE INVENTION

Buckles and modified buckles are well known in the prior art. However, there are often situations where a buckle on military equipment or outdoor gear will break or otherwise become damaged. For example, bags carried for outdoor excursions or military operations may have multiple buckles for attaching various supplies, such as a medical kit, canteen, or tools. If the buckle is broken or badly damaged, the entire bag may be rendered unusable because the buckle is integral with the strap on which it is affixed. Thus, there exists a need for a device that can allow users to easily replace buckles on items which require them.

Further, there are numerous situations where a user might want to employ the use of a buckle when there is not one present. For example, this might occur when transporting large quantities of goods such as in a move or a shipment. This may also occur in military and outdoor settings where numerous supplies must be attached to one item that can be easily carried by the user. Therefore, there exists a need for an adaptable buckle that can be secured to a loop at the end of a rope or any like material. This will allow use of the buckle at the discretion of the user.

Devices are known in the prior art that relate to replaceable or adaptable buckles. Devices in the prior art generally relate to buckles comprising a latch or lever to attach the buckle onto a strap. Some devices provide a buckle with an aperture at the free end allowing the buckle to slide onto the strap. However, these devices fail to include an interlocking side-release mechanism with a pronged arm that receives a loop in a strap or cable and locks into apertures.

SUMMARY OF THE INVENTION

In view of the foregoing disadvantages inherent in the known types of buckles now present in the prior art, the present invention provides an interlocking side-release mechanism wherein the user can attach a buckle to a loop created by any material adaptable to receive a buckle. The present system comprises two component members. The first component member has a female connector at one end and an interlocking side-release mechanism on the other end. Similarly, the second component has a male connector at one end and an interlocking side-release mechanism on the other end.

The interlocking side-release mechanism comprises an arm with one or more prongs and a receiver with one or more apertures configured to receive the prongs. The placement of the apertures may be such that the prongs are received at different locations thereby providing structural stability. Ridges on the prongs and apertures interact in a cross-biting action keeping the prongs locked in place. The prongs are released when the user twists the arm thereby rotating the prongs.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
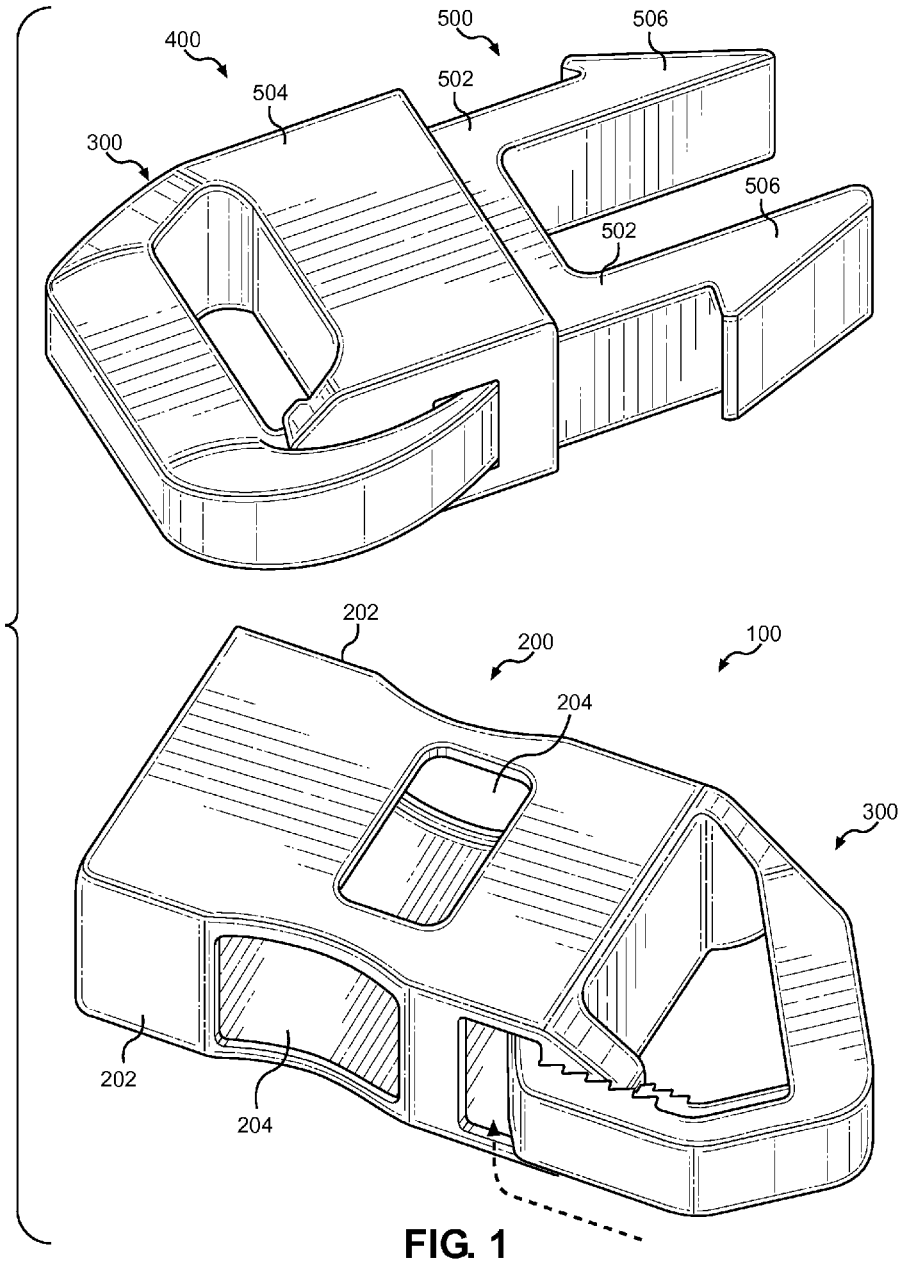
FIG. 1 shows a perspective view of the adaptable buckle system.

Reference is made herein to the attached drawings. Like reference numerals are used throughout the drawings to depict like or similar elements of the adaptable buckle system. For the purposes of presenting a brief and clear description of the present invention, the preferred embodiment will be discussed as used for securing the adaptable buckle system to loops at the end of straps. The figures are intended for representative purposes only and should not be considered to be limiting in any respect.

Referring now to FIG. 1, there is shown a perspective view of the adaptable buckle system. The adaptable buckle system comprises two component members. The first component 100 comprises a body having a first end and a second end. The first end includes a female connector 200 and the second end includes an interlocking side-release mechanism 300. The female connector 200 is hollow and semi-rectangular with side walls 202. One or more apertures 204 are disposed on the side walls 202. The apertures 204 are configured to receive a male connector.

The second component 400 comprises a body having a first end and a second end. The first end includes a male connector 500 and the second end includes an interlocking side-release mechanism 300. The male connector 500 comprises one or more arms 502 that extend perpendicularly from a base 504. In the illustrated embodiment, the male connector 500 comprises a pair of arms 502. The arms 502 also extend parallel to each other. Each arm 502 has a hook 506 that allows the second component to be removably fastened to the first component 100. For fastening, the arms 502 and hooks 506 of the male connector 500 are received by the female connector 200. The apertures 204 on the side walls 202 of the female connector 200 receive the hooks 506. The hooks 506 remain securely in place until the user applies inward pressure to the hooks 506 while simultaneously pulling the second component 400 outward and away from the first component 100.

Figure 2:
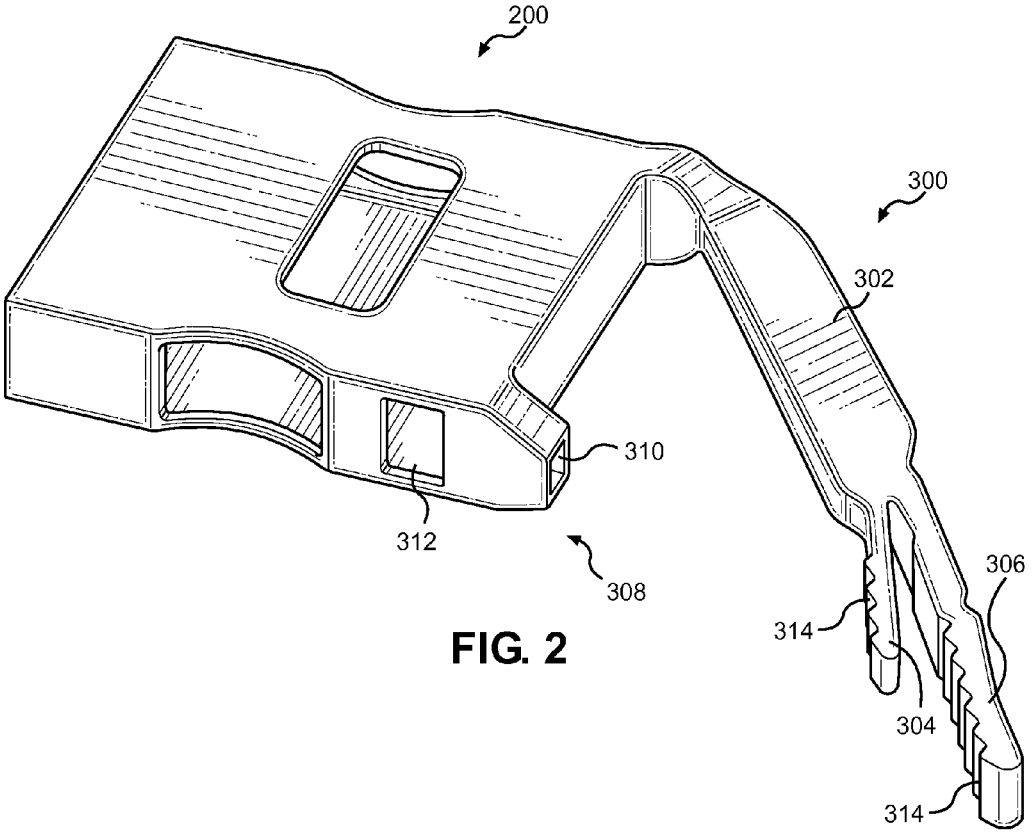
FIG. 2 shows a close-up view of the interlocking side-release mechanism.
Figure 3:
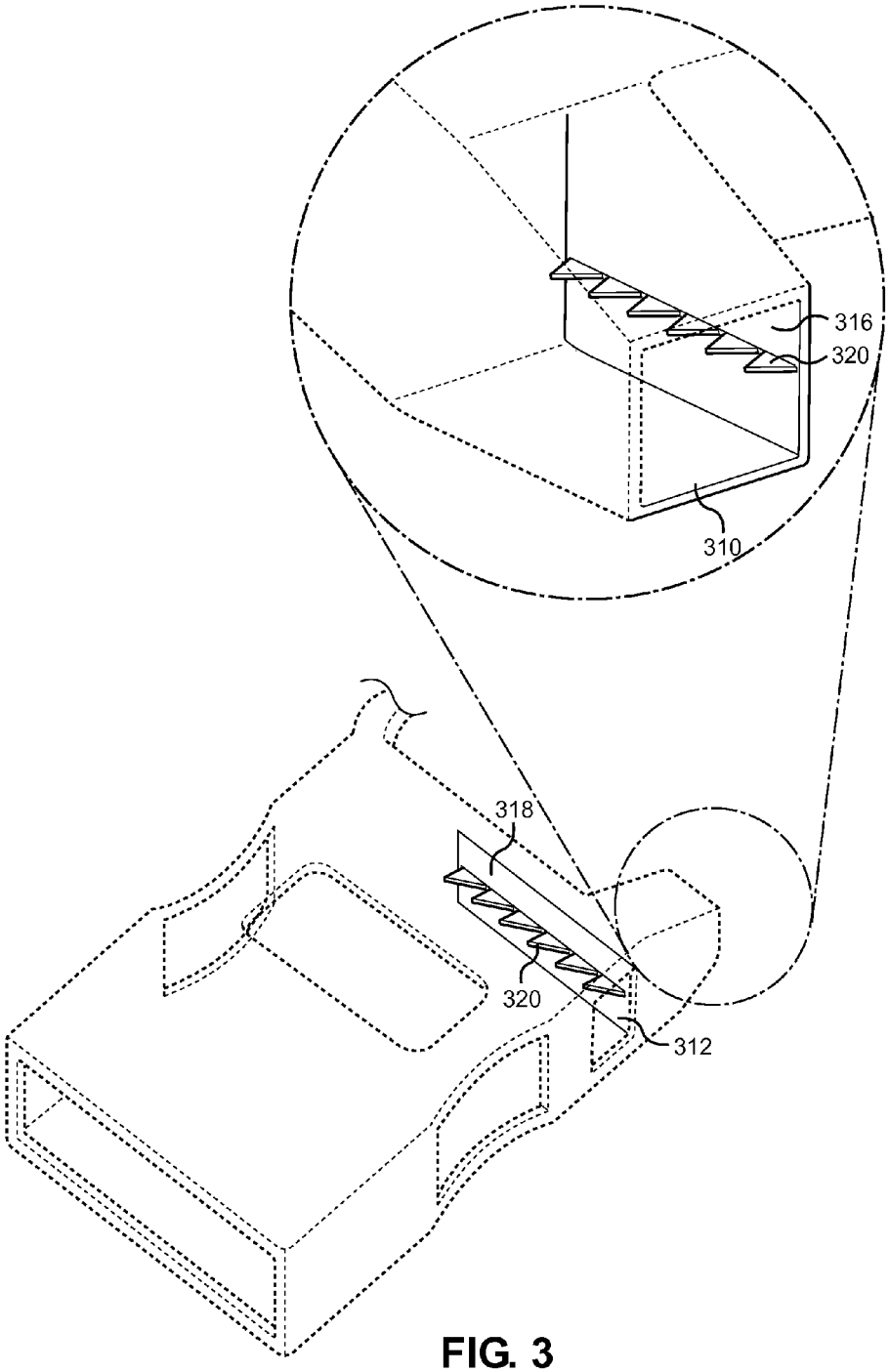
FIG. 3 shows a detail view of an embodiment of the receiver.

Referring now to FIGS. 2 and 3, there are shown different views of the interlocking side-release mechanism. The interlocking side-release mechanism 300 comprises a flexible arm 302 pivotally affixed to a first side of the connector, wherein a free end of the arm 302 is adapted to removably engage with a receiver 308 on a second side of the connector. The receiver 308 preferably includes one or more apertures adapted to receive one or more flexible prongs on the free end of the arm 302. In various embodiments, the prongs are different lengths. The difference in length allow the prongs to be inserted into multiple apertures, thereby offering greater structural integrity.

In the depicted embodiment, the arm 302 has a first prong 304 and a second prong 306 extending from the free end. After the arm 302 has been fed through a loop of material, the prongs can be removably inserted into two apertures of the receiver 308. The first aperture 310 is configured to receive the first prong 304. The second aperture 312 is configured to receive the second prong 306. In the depicted embodiment, the first aperture 310 is perpendicular to the second aperture 312. Therefore, when locked into place, the first prong 304 is perpendicular to the second prong 306, which contributes to greater structural integrity.

A prong is locked into place within the aperture through cross-biting action of ridges that line both the prong and the aperture. In the depicted embodiment, the first prong 304 and the second prong 306 have an inner surface and an outer surface with a plurality of ridges 314 lining the inner surface. Likewise, an inner wall 316 of the first aperture 310 and an inner wall 318 of the second aperture 312 are lined with a plurality of ridges 320. This not only allows the ridges 314 on a prong to grab the ridges 320 on the inner wall of an aperture, but also enables the user to disengage the cross-biting action of the ridges by twisting the arm 302 thereby rotating a prong.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adaptable buckle system, comprising:

a first component member and a second component member, each comprising a body having a first end and a second end, the first end of the first component member comprising a female connector and the first end of the second component member comprising a male connector;

an interlocking side-release mechanism on the second end of each body comprising an arm pivotally affixed to a first side of the body, wherein a free end of the arm is adapted to removably engage with a receiver on a second side of each body, the receiver comprising an aperture adapted to receive a prong on the free end of the arm; and a plurality of ridges lining the prong and the aperture.

2. The adaptable buckle system of claim 1, wherein the female connector is hollow and semi-rectangular with a side wall and an aperture disposed on the side wall.

3. The adaptable buckle system of claim 1, wherein the male connector comprises at least one arm extending perpendicularly from a base, the arm comprising a hook.

4. The adaptable buckle system of claim 1, wherein the prong has an inner surface and an outer surface, a plurality of the ridges disposed along the inner surface.

5. The adaptable buckle system of claim 1, wherein the aperture has an inner wall, a plurality of the ridges disposed along the inner wall.

6. The adaptable buckle system of claim 1, wherein the arm and the prong are composed of a flexible material.

7. The adaptable buckle system of claim 1, wherein the receiver comprises two apertures arranged perpendicularly to one another.

* * * * *